US006698750B1

(12) United States Patent
Moser

(10) Patent No.: US 6,698,750 B1
(45) Date of Patent: Mar. 2, 2004

(54) MEDIA TRAY REFILL SHUTTLE

(75) Inventor: Steven G. Moser, Salt Lake City, UT (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/339,991

(22) Filed: Jan. 10, 2003

(51) Int. Cl.[7] ..... B65H 1/026
(52) U.S. Cl. ..... 271/157
(58) Field of Search ..... 271/157, 162; 399/107; B65H 1/26, 1/00

(56) References Cited

U.S. PATENT DOCUMENTS 4,556,210 A * 12/1985 George ..... 271/157
4,921,388 A * 5/1990 Nelson ..... 414/412
5,263,701 A * 11/1993 Kleinhen ..... 271/145
5,951,135 A 9/1999 Bigelow et al. ..... 353/30
5,996,991 A * 12/1999 Dirx et al. ..... 271/149
6,139,008 A 10/2000 Margiotta ..... 271/148
6,209,865 B1 4/2001 Regimbal et al. ..... 271/220
6,254,084 B1 7/2001 Hellmer ..... 271/126

FOREIGN PATENT DOCUMENTS

JP 2002-37464 * 2/2002 ..... B65H/1/04

* cited by examiner

*Primary Examiner*—Donald P. Walsh
*Assistant Examiner*—Kenneth W Bower

(57) ABSTRACT

A media tray refill shuttle for inserting print media into a media tray of an imaging device, for instance an inkjet printer. In one embodiment, refill print media is inserted into the media tray while the imaging device is actively printing a print job. The media tray refill shuttle includes a media support cassette and a media shuttle which is moveable with respect to the media support cassette to displace a refill media from the media support cassette into the media tray of the imaging device by operation of a media shuttle translation assembly or element.

16 Claims, 4 Drawing Sheets

MEDIA TRAY REFILL SHUTTLE

BACKGROUND OF THE INVENTION

1. Technical Field

The present invention relates to imaging devices and more particularly to a device which assists an operator in replacing a supply of media in a media tray.

2. Background Art

Presently, media trays for many imaging devices are configured such that a print job must be paused or terminated in order to place additional print media in the media tray. When an imaging device runs out of media, the print job is paused and an error message is generated by the printer. The media supply is replenished and the print job resumes by a prompt from the user or automatically by the printer. This process may result is wasted time.

In many prior art imaging devices, paper or other media is placed into an open-front media tray by first pulling a generally vertically oriented tab which is connected to a slide arm that extends below the supply of media in the media tray. If paper remains in the tray, the trailing edge of the stack of remaining media is manually lifted and a leading edge of a stack of replacement media is positioned underneath the trailing edge of the stack of remaining media and laid along the length of the extended slide arm. The media is advanced forward in the tray by pushing the tab connected to the slide arm advancing the tab, the slide arm and the replacement media beneath the remaining media. The leading edge of the stack of replacement media may be damaged during this operation due to the fact that the media has a tendency to curve along the unsupported leading edge. As such, the stack of replacement media may be inadvertently pushed against the rear edge of the tray crimping, dinging or otherwise damaging the media.

There may be an advantage found in providing a device that assists with replenishing a supply of print media in a media tray. Additionally, advantage may be found in providing a device that supports the leading edge of a stack of replacement media so that risk of damage to a leading edge of the stack of replacement media may be minimized. In addition, advantage may be found in providing a device that assists with replenishing a supply of print media in a media tray while a print job continues without interruption.

SUMMARY OF THE INVENTION

The present invention is directed to a media tray refill shuttle for inserting a refill media into a media tray. The media tray refill shuttle includes a media support cassette including a media shuttle receiver and a media shuttle slideably engaged with the media support cassette. The media tray refill shuttle also includes a media shuttle translation element connected to the media shuttle for advancing the media shuttle from a first position, wherein the refill media is positioned and supported within the media support cassette towards a second position, wherein the refill media is shuttled from the media support cassette.

As used herein, the term "media" includes printable paper media, transparency media and photographic or image printing media. Likewise, the term "media tray" shall include printable paper media trays, transparency media trays and photographic or image printing media trays.

The present invention consists of the device hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION

Figure 1:
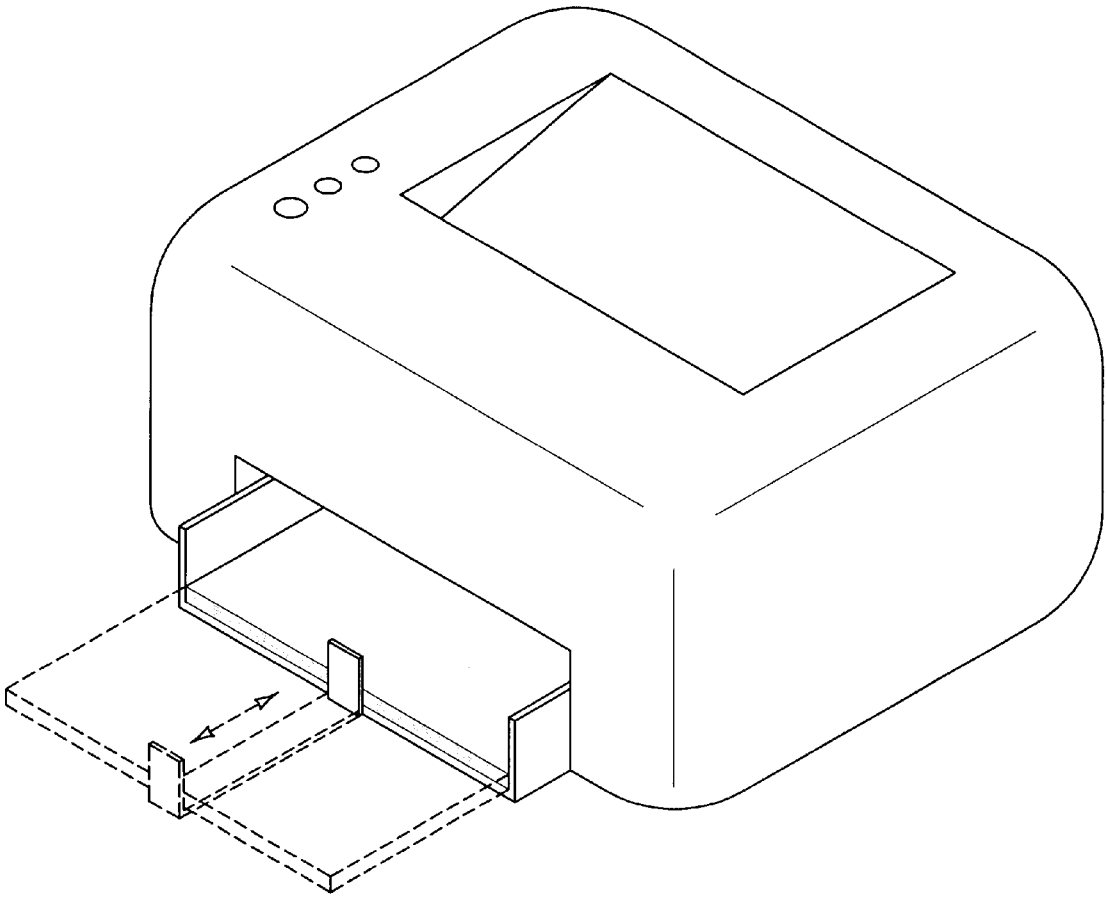
FIG. 1 (Prior Art)
FIG. 1 is a perspective representation showing an imaging device including a media tray according to the prior art.
Figure 2:
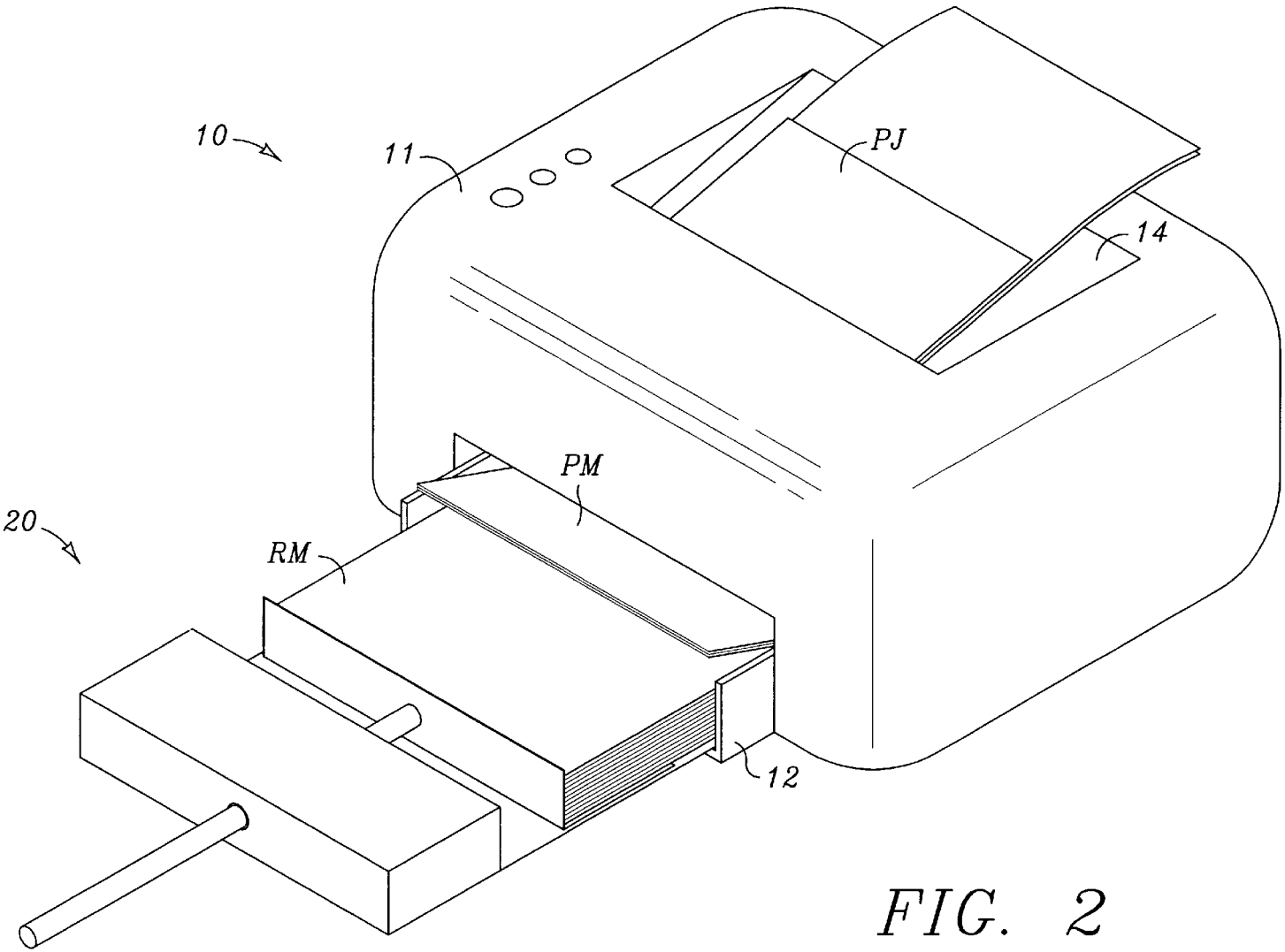
FIG. 2 is a perspective representation showing a media tray refill shuttle used to place refill media in a media tray of an imaging device according to one embodiment.

FIG. 2 shows imaging device 10 including housing 11 which supports media tray 12. Media tray refill shuttle 20 is shown inserted into imaging device 10 housing 11, media tray 12 projecting from housing 11. Refill media RM is shown being shuttled beneath remaining print media PM stacked in media tray 12 by operation of media tray refill shuttle 20. Print job PJ is deposited to output media tray 14.

Figure 3:
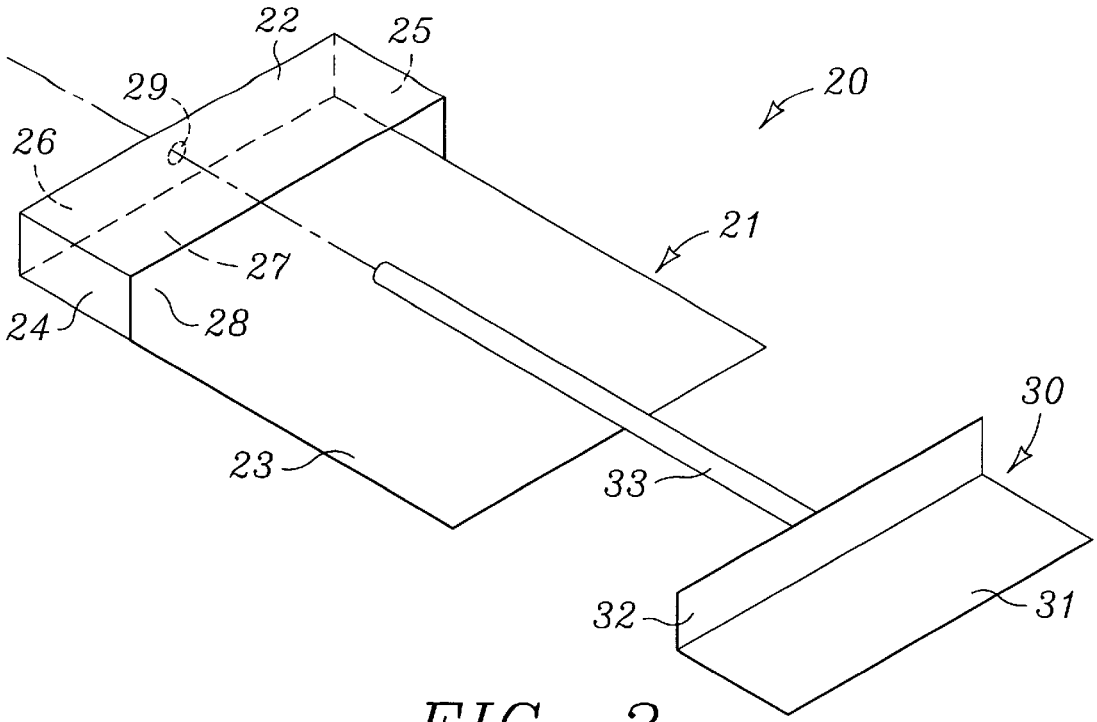
FIG. 3 is an exploded perspective representation showing a media tray refill shuttle according to one embodiment.
Figure 4:
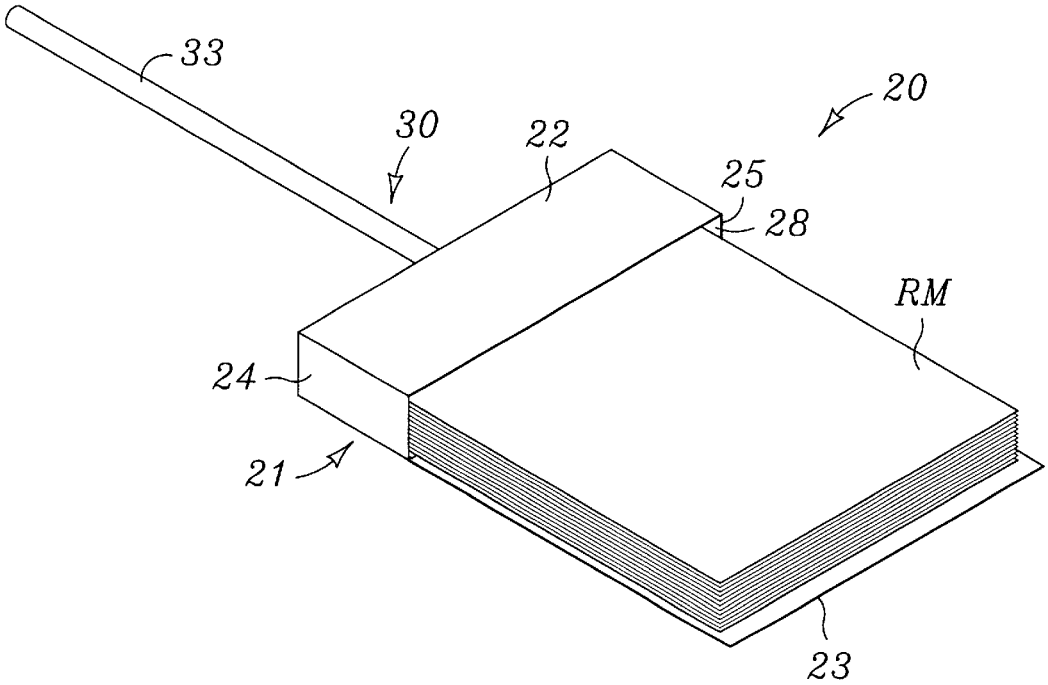
FIG. 4 is a perspective representation showing a media tray refill shuttle according to one embodiment.

FIGS. 3 and 4 show media tray refill shuttle 20 including support cassette 21 and media shuttle 30. Media support cassette 21 includes support cassette upper panel 22 and support cassette lower panel 23 arranged in spaced apart and substantially parallel relationship. Support cassette upper panel 22 and support cassette lower panel 23 are attached by first side panel 24 and second side panel 25, which are also arranged in spaced apart and substantially parallel relationship. Media support cassette 21 also includes support cassette rear panel 26 which attaches to support cassette upper panel 22, support cassette lower panel 23, first side panel 24 and second side panel 25. Receiver pocket 27 and media support cassette aperture 28 are defined by the described arrangement of support cassette upper panel 22, support cassette lower panel 23, support cassette rear panel 26, first side panel 24, (shown in FIGS. 3 and 4), and second side panel 25.

Media shuttle 30 includes lower panel 31 attached to rear panel 32 at a substantially right angle. Pushrod 33 is attached to rear shuttle panel 32 of media shuttle 30 and serves as a media shuttle translation assembly or element for advancing media shuttle 30 from a first position, shown in FIG. 5, wherein the refill media is positioned and supported within the media support cassette towards a second position, shown in FIG. 6, wherein the refill media is shuttled from media support cassette 21 to media tray 12, as shown in FIG. 2. Pushrod 33 is located so as to protrude through pushrod aperture 29 formed in rear cassette panel 26 upon insertion of media shuttle 30 into media support cassette 21.

FIG. 4 shows refill media RM positioned within receiver pocket 27 of media support cassette 21 and supported by support cassette lower panel 23. First side panel 24 and second side panel 25 align the side edges of refill media RM.

Figure 5:
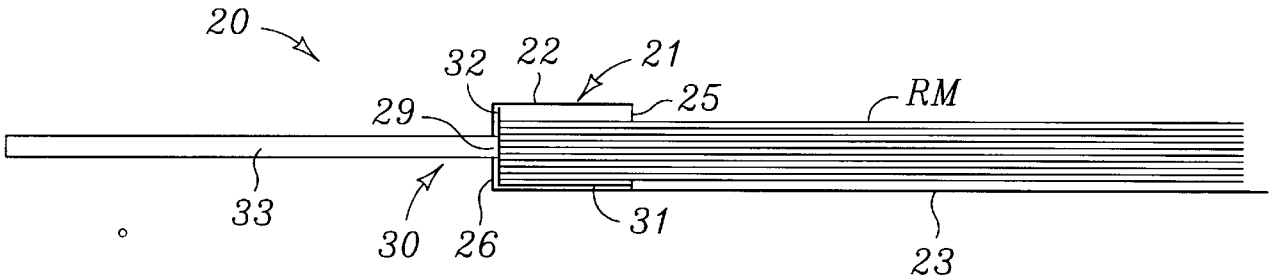
FIG. 5 is a side cutaway representation showing a media tray refill shuttle according to one embodiment.
Figure 6:
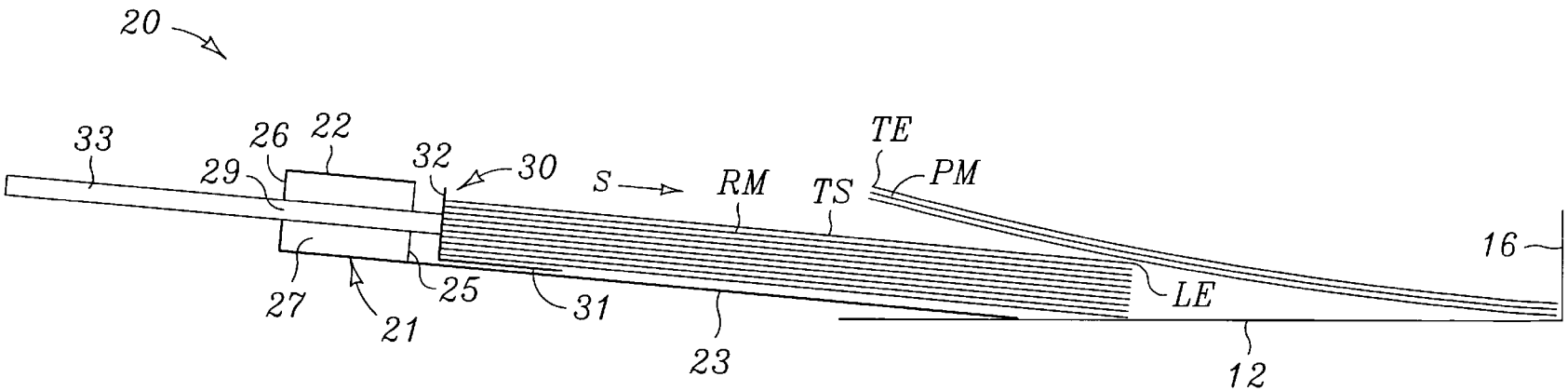
FIG. 6 is a side cutaway representation showing a media tray refill shuttle used to place refill media in a media tray of an imaging device according to one embodiment.

FIGS. 5 and 6 show refill media RM positioned within receiver pocket 27 of media support cassette 21 and supported by support cassette lower panel 23. FIG. 5 shows media shuttle 30 in a first position wherein rear panel 32 of media shuttle 30 is positioned against support cassette rear panel 26 and refill media RM is positioned and supported within receiver pocket 27 of media support cassette 21. FIG. 6 shows media shuttle 30 moving or being shuttled along line S towards a second position wherein refill media RM is shuttled from media support cassette 21 beneath print media PM. Leading edge LE of refill media RM is inserted beneath a trailing end TE of the stack of print media PM with support cassette lower panel 23 resting on media tray 12. Print media PM may rest on top surface TS of refill media RM as shown. Refill media RM is shuttled forward into media tray 12 by operation of media tray refill shuttle 20 towards forward media indexing surface 16.

While this invention has been described with reference to the detailed embodiments, this is not meant to be construed in a limiting sense. Various modifications to the described embodiments, as well as the inclusion or exclusion of additional embodiments, will be apparent to persons skilled in the art upon reference to this description. It is therefore contemplated that the appended claims will cover any such modifications or embodiments as fall within the true scope of the invention.

What is claimed is:

1. A media tray refill shuttle for inserting a refill media into a media tray, the media tray refill shuttle comprising:

a media support cassette including a media shuttle receiver;

a media shuttle slideably engaged with the media support cassette; and a media shuttle translation element connected to the media shuttle for advancing the media shuttle from a first position, wherein the refill media is positioned and supported within the media support cassette towards a second position, wherein the refill media is shuttled from the media support cassette.

2. The media tray refill shuttle of claim 1 wherein the media support cassette further comprises:

a support cassette lower panel;

a first side panel connected to the support cassette lower panel;

a second side panel connected to the support cassette lower panel, the second side panel arranged in spaced apart and substantially parallel relationship to the first side panel; and a support cassette rear panel attached to the support cassette lower panel.

3. The media tray refill shuttle of claim 1 wherein the media shuttle further comprises:

a media shuttle lower panel; and a media shuttle rear panel attached to the media shuttle lower panel at a substantially right angle.

4. The media tray refill shuttle of claim 1 wherein the media shuttle translation element further comprises a pushrod connected to the media shuttle for advancing the media shuttle from a first position, wherein the refill media is positioned and supported within the media support cassette towards a second position, wherein the refill media is shuttled from the media support cassette.

5. The media tray refill shuttle of claim 2 further comprising a pushrod aperture formed in the support cassette rear panel, the media shuttle translation element slideably extendable through the pushrod aperture.

6. The media tray refill device of claim 2 wherein the media support cassette further comprises a support cassette upper panel attached to the support cassette rear panel, the support cassette upper panel arranged in spaced apart and substantially parallel relationship to the support cassette lower panel.

7. A media tray refill shuttle for inserting a refill media in a media tray, the media tray refill shuttle comprising:

a media support cassette including a media shuttle receiver, a support cassette lower panel, a first side panel connected to the support cassette lower panel, a second side panel connected to the support cassette lower panel, the second side panel arranged in spaced apart and substantially parallel relationship to the first side panel and a support cassette rear panel attached to the support cassette lower panel;

a media shuttle slideably engaged with the media support cassette, the media shuttle including a media shuttle lower panel and a media shuttle rear panel attached to the media shuttle lower panel at a substantially right angle; and a media shuttle translation assembly connected to the media shuttle for advancing the media shuttle from a first position, wherein the refill media is positioned and supported within the media support cassette towards a second position, wherein the refill media is shuttled from the media support cassette.

8. The media tray refill shuttle of claim 7 further comprising a pushrod aperture formed in the support cassette rear panel, the media shuttle translation assembly slideably extendable through the pushrod aperture.

9. The media tray refill device of claim 7 wherein the media support cassette further comprises a support cassette upper panel attached to the support cassette rear panel, the support cassette upper panel arranged in spaced apart and substantially parallel relationship to the support cassette lower panel.

10. The media tray refill shuttle of claim 7 wherein the media shuttle translation assembly further comprises a pushrod connected to the media shuttle for advancing the media shuttle from a first position wherein the refill media is positioned and supported within the media support cassette towards a second position wherein the refill media is shuttled from the media support cassette.

11. An imaging device for forming an image on a print media, the imaging device comprising:

an imaging device housing;

a media tray connected to the imaging device housing for providing media to the imaging device;

a media tray refill shuttle for inserting a refill media in the media tray, the media tray refill shuttle including a media support cassette including a media shuttle receiver;

the media tray refill shuttle also including a media shuttle slideably engaged with the media support cassette; and a media shuttle translation assembly connected to the media shuttle for advancing the media shuttle from a first position wherein the refill media is positioned and supported within the media support cassette towards a second position wherein the refill media is shuttled from the media support cassette.

12. The media tray refill shuttle of claim 11 wherein the media support cassette further comprises:

a support cassette lower panel;

a first side panel connected to the support cassette lower panel;

a second side panel connected to the support cassette lower panel, the second side panel arranged in spaced apart and substantially parallel relationship to the first side panel; and a support cassette rear panel attached to the support cassette lower panel.

13. The media tray refill shuttle of claim 11 wherein the media shuttle further comprises:

a media shuttle lower panel; and a media shuttle rear panel attached to the media shuttle lower panel at a substantially right angle.

14. The media tray refill shuttle of claim 11 wherein the media shuttle translation assembly further comprises a pushrod connected to the media shuttle for advancing the media shuttle from a first position wherein the refill media is positioned and supported within the media support cassette towards a second position wherein the refill media is shuttled from the media support cassette.

15. The media tray refill shuttle of claim 12 further comprising a pushrod aperture formed in the support cassette rear panel, the media shuttle translation assembly slideably extendable through the pushrod aperture.

16. The media tray refill device of claim 12 wherein the media support cassette further comprises a support cassette upper panel attached to the support cassette rear panel, the support cassette upper panel arranged in spaced apart and substantially parallel relationship to the support cassette lower panel.

* * * * *